United States Patent [19]

Abe et al.

[11] 4,433,665

[45] Feb. 28, 1984

[54] DEVICE FOR CONTROLLING CHOKE VALVE IN CARBURETOR FOR INTERNAL COMBUSTION ENGINE

[75] Inventors: Seiko Abe, Kariya; Toshihiko Igashira, Toyokawa; Hisasi Kawai, Toyohashi; Toshikazu Ina, Aichi; Masayoshi Tokoro, Susono, all of Japan

[73] Assignees: Nippon Soken, Inc., Nishio; Toyota Jidosha Kogyo Kabushiki Kaisha, Toyota, both of Japan

[21] Appl. No.: 361,099

[22] Filed: Mar. 23, 1982

[30] Foreign Application Priority Data

Mar. 23, 1981 [JP] Japan ..... 56-38922[U]

[51] Int. Cl.[3] ..... F02M 1/02

[52] U.S. Cl. ..... 123/552; 123/556; 123/179 G; 261/64 E

[58] Field of Search ..... 261/64 E, 64 R; 123/179 G, 179 R, 339, 340, 554, 556

[56] References Cited

U.S. PATENT DOCUMENTS 3,948,240 4/1976 Hirosawa et al. ..... 261/64 R X 4,321,902 3/1982 Stoltman ..... 123/179 G X

FOREIGN PATENT DOCUMENTS 56-32061 4/1981 Japan ..... 261/64 E

*Primary Examiner*—William A. Cuchlinski, Jr.

*Attorney, Agent, or Firm*—Cushman, Darby & Cushman

[57] ABSTRACT

The degree of opening of the choke valve in a carburetor for an internal combustion engine is controlled in accordance with the temperature of at least one predetermined position of temperature adjustment devices in the air intake manifold portion of the engine, whereby emission of harmful exhaust gas is reduced and the rated fuel consumption of the engine is maintained.

11 Claims, 10 Drawing Figures

DEVICE FOR CONTROLLING CHOKE VALVE IN CARBURETOR FOR INTERNAL COMBUSTION ENGINE

FIELD OF THE INVENTION

The present invention relates to a device for controlling a choke valve in a carburetor for an internal combustion engine.

In general, carburetors for internal combustion engines do not satisfactorily atomize the fuel immediately after the start of the engine, hence supplying a fuel-air mixture to the engine of a ratio leaner than that predetermined. This prevents satisfactory engine operation. To counter this, a choke valve is used to increase the supply of fuel to the carburetor immediately after the engine has started.

The usual methods for controlling the choke valve include warm water control, electricl heating control, and manual control. In warm water control, the rise of the engine coolant temperature causes deflection of a bi-metallic strip to increase the degree to which the choke valve is open. In electric heating control, the battery voltage is supplied to a positive temperature coefficient heater or a nichrome wire heater, located adjacent to the choke valve, simultaneously with the start of the engine. The heater produces heat to deflect a bi-metallic strip to increase the degree of opening of the choke valve. In manual control, an operator closes the choke valve via a wire at the time of engine start and manually opens the valve after an appropriate length of time.

While smooth engine operation can be achieved by the above-described control methods, the increased fuel supply reduces the rated fuel consumption and increases the exhaust gas emission.

A device has been proposed in which an electric heater is provided in the fuel path from the carburetor to the engine. This device can be used to shorten the duration of choke operation. Although the temperature of the heater varies in accordance with the engine load, the intake air temperature and the like, the degree of opening of the choke valve increases only gradually. When the engine load is light, the temperature of the heater is raised and hence the satisfactory atomization of the fuel is achieved. Accordingly, the degree of opening of the choke valve can be increased more than usual. When the temperature is not raised due to the failure of the heater, engine operation will become unstable, unless the amount of fuel supply is increased. Thus, attention should be drawn to the relationship between the heater temperature and the degree of opening of the choke valve. Therefore, it has been a problem that the unstable running of the engine and the deterioration of the rated fuel consumption may be caused, unless the relationship between the heater temperature and the opening degree of the choke valve is maintained appropriately.

SUMMARY OF THE INVENTION

In view of the above-described problems, it is the main object of the present invention to provide an improved device for controlling a choke valve in a carburetor for an internal combustion engine, said device reducing emission of harmful exhaust gas and maintaining the rated fuel comsumption of the engine.

It is another object of the present invention to provide an improved device for controlling a choke valve in a carburetor for an internal combustion engine, said device preventing unstable running of the engine when the operation of the intake air heating device becomes defective.

According to an aspect of the present invention, there is provided a device for controlling a choke valve in a carburetor for an internal combustion engine, comprising: means for detecting the temperature of at least one predetermined position in temperature adjustment devices in the air intake manifold portion of the engine; a control circuit for receiving the signal from said temperature detection means to carry out a predetermined process of computation; and driving means responsive to the output signal of said control circuit for changing the degree of opening of said choke valve.

According to another aspect of the present invention, there is provided a device for controlling a choke valve in a carburetor for an internal combustion engine, comprising: means for detecting the temperature of at least one predetermined position of temperature adjustment devices in the air intake manifold portion of the engine, the choke valve pulling angle under the perfect combustion condition of the engine being selected in accordance with the signal obtained as the result of said temperature detection.

DETAILED DESCRIPTION OF THE INVENTION

Figure 1:
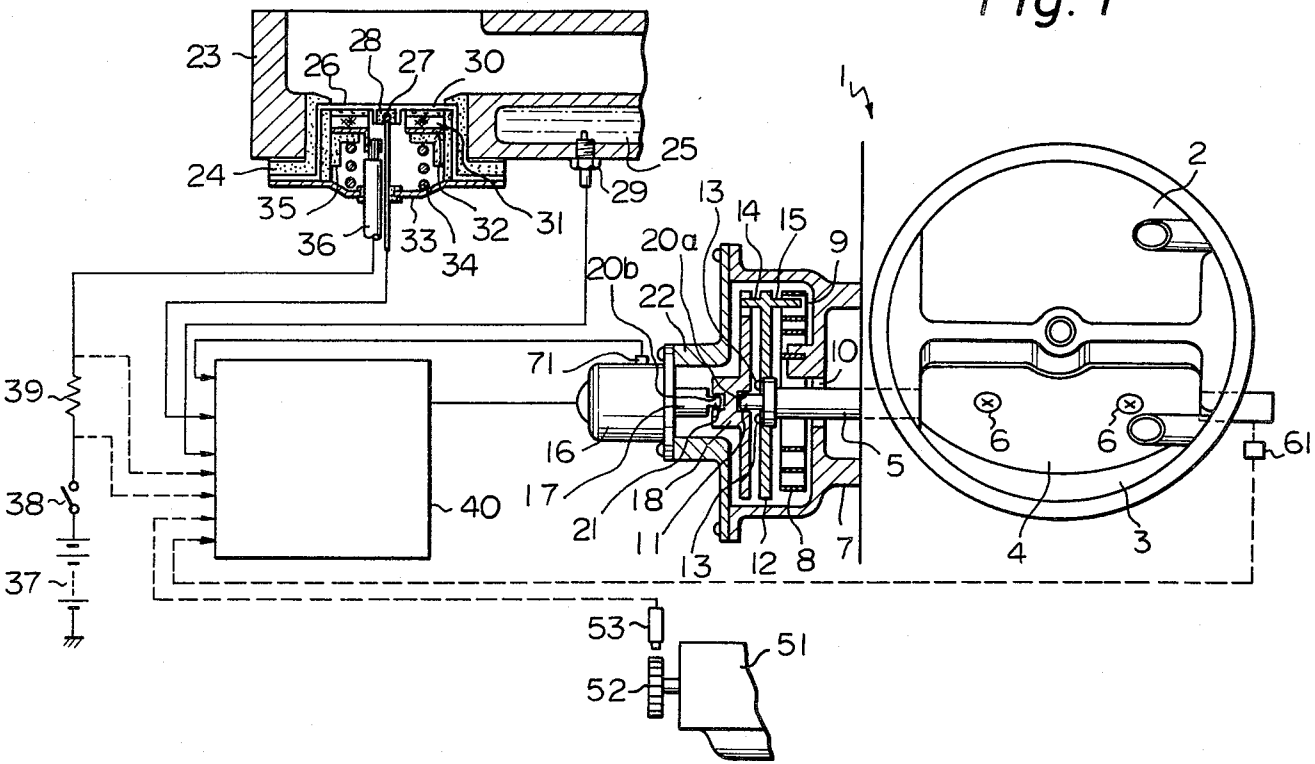
FIG. 1 illustrates a device for controlling a choke valve in a carburetor for an internal combustion engine according to an embodiment of the present invention.
Figure 2:
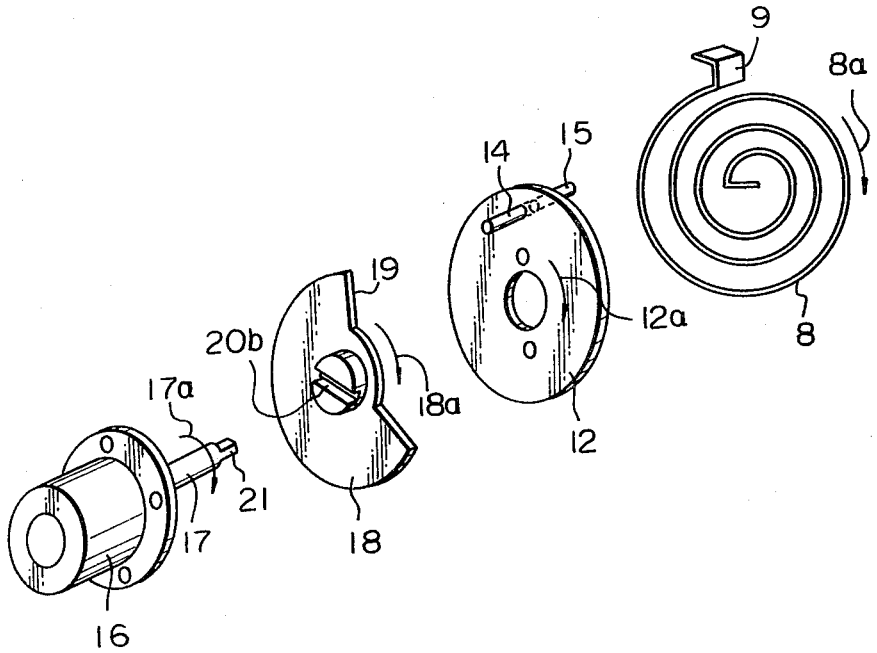
FIG. 2 illustrates the elements of the choke valve used in the device of FIG. 1.

A device for controlling a choke valve in a carburetor for an internal combustion engine according to an embodiment of the present invention is illustrated in FIG. 1. The carburetor 1 comprises a first bore 3 and a second bore 2. In the first bore 3, a choke valve 4 is hinged to a shaft 5 enabling opening and closing action of the choke valve 4. The driving mechanism of the choke valve 4 is illustrated in FIG. 2. A choke case 7 is fixed to the carburetor 1. A spiral spring 8 is provided in the choke case 7, the inner end of the spiral spring 8 being fixed to the choke case 7, and the outer end of the spiral spring forming a claw 9. The choke case 7 has a through hole 10 at the central portion thereof through which the shaft 5 extends. An actuator plate 12 operable to open and close the choke valve 4 is fixed to the shaft 5 by screws 13, 13 and is adapted to rotate in association with the shaft 5. A pin 14 and pin 15 are provided at the peripheral portion of the actuator plate 12 on the side facing a plate 18 to drive the choke valve 4 and on the side facing the spiral spring 8 to engage with the claw 9 of the spiral spring 8, respectively. The pin 14 is adapted to abut to the edge 19 of the plate 18 which is arranged between a shaft 17 of the motor 16, aligned with the shaft 5 for driving the choke valve, and the shaft 5. The end of the shaft 5 is inserted in a groove 20*a* provided at the center of the plate 18 so as to enable the plate 18 to rotate with respect to the shaft 5.

The end 21 of the driving shaft 17 is fitted in a groove 20*b* provided at the center of the plate 18. The motor 16 for driving the choke valve is fixed to a choke case cap 22 fixed to the choke case 7. The motor 16 is supplied with the output signal of the control circuit 40. The motor 16 provides a reduction gear having a gear ratio 1:20 and a potentiometer 19 for detecting the rotational angle of the shaft. The shaft 17 is the output shaft of the reduction gear. The range of the rotational angle of the shaft is 90°.

The device of FIG. 1 provides an air intake manifold 23, an intake air heating device including a heater 24, and a coolant path passing the coolant water 25. A heater plate 26 is provided in the intake air heating device. A temperature detector element 27 is provided at the center of the bottom surface of the heater plate 26. The temperature detector element 27 is fixed by a surrounding filling 28. The output signal of the temperature detector element 27 is supplied to the control circuit 40. A water temperature detector element 29 is provided in the path of the coolant water 25. The output signal of the water temperature detector element 29 is also supplied to the control circuit 40. The heater 24 comprises a positive temperature coefficient (PTC) ceramic heater 30 of a thin doughnut plate form, a cushion member 31, a positive electrode plate 32, a spacer 35, and a helical spring 34 capped by a bottom plate 33. The heater 30, the cushion member 31, the electrode plate 32, and the spacer 35 are pressed to the heater plate 26 by the helical spring 34.

The operation of the device of FIG. 1 will now be described. At the start of the operation of a cold engine, when voltage is supplied from a battery power source 37 and through a key-switch 38 to the heater 24, the current passes through a conductor 36, the positive electrode plate 32, the cushion member 31, the PTC ceramic heater 30, the heater plate 26, a screw bolt (not shown), and the air intake manifold 23. The PTC ceramic heater produces heat which is transmitted to the heater plate 26.

The fuel-air mixture supplied from the carburetor 1 flows against the heater plate 26, whose heat atomizes the fuel. The temperature of the heating surface varies in accordance with the amount of fuel and the temperature of the intake air. If no current is supplied to the heater 24, the temperature of the heater plate 26 is low and, hence, the engine will not operate properly. To avoid this, the temperature of the heating surface is detected by the temperature detector element 27 provided on the bottom of the heater plate 26, and a signal representing the detected temperature is supplied to the control circuit 40. The output signal of the control circuit 40 is supplied to the motor 16, which then operates the choke valve 4 to open the choke valve 4 to a degree corresponding to the temperature of the heater plate 26.

The driving mechanism of the choke valve 4 is illustrated in FIG. 2. The shaft 21 of the motor 16 for driving the choke valve is rotated in the direction 17*a*. The plate 18 for driving the choke valve is rotated in the direction 18*a*, because the end 21 of the shaft 17 is fitted to the groove 20*b* of the plate 18. The actuator plate 12 is rotated in the direction 12*a*, because the pin 14 of the actuator plate 12 is driven by the edge 19 of the plate 18. Thus, the choke valve 4 fixed to the actuator plate 12 is driven so as to increase the degree of opening of the choke valve.

In this case, the spiral spring 8 is resiliently shrunken in the direction 8*a*, because the claw 9 of the spiral spring 8 is engaged with the pin 15 of the actuator plate 12. After that, if the motor 16 is rotated in the direction opposite to 17*a*, the actuator plate 12 is driven by the spiral spring 8 to rotate in the direction opposite to 12*a*, hence the choke valve 4 is driven to reduce the degree of opening of the choke valve 4.

When the shaft 17 of the motor 16 is at a given angular position, the degree of opening of the choke valve 4 can be increased by the passage of a larger amount of air through the choke valve to the engine and can be reduced after such increase of the opening degree by the resilient force of the spiral spring.

Consequently, the control circuit 40 will rotate the motor 16 to reduce the degree of opening of the choke valve if the temperature of the heater plate 26 is lower than a predetermined temperature, and will rotate the motor 16 to increase the degree of opening of the choke valve to the full-open position if the temperature of the heater plate 26 is higher than the predetermined temperature.

The temperature of the coolant water 25 in the coolant path is detected by the water temperature detector element 29, and the signal representing the detected temperature is supplied to the control circuit 40. The control circuit 40 produces a signal to drive the motor 16 to increase the degree of opening of the choke valve to the full-open position regardless of the temperature of the heater plate 26, if the signal representing the detected temperature of the coolant water is higher than a predetermined temperature.

Figure 3:
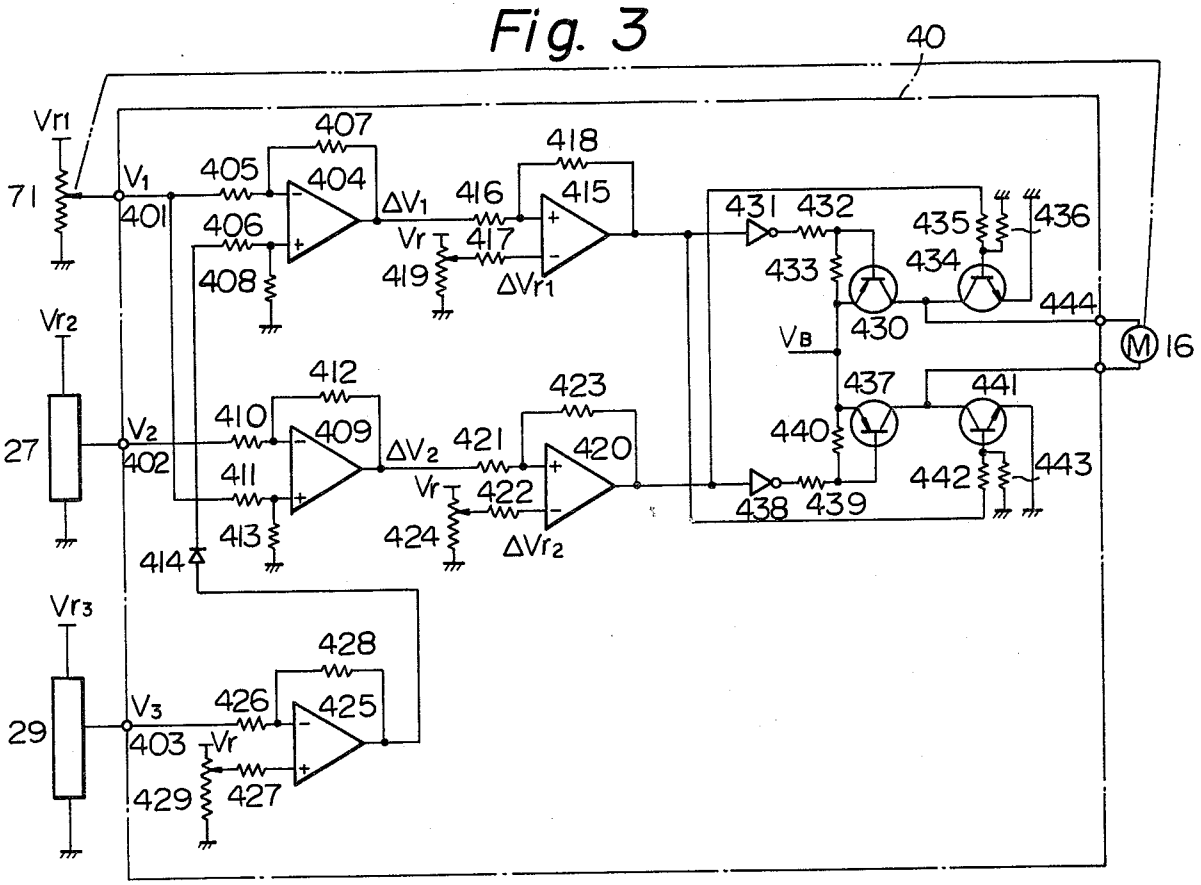
FIG. 3 illustrates a circuit diagram of an example of the control circuit included in the device of FIG. 1.

The structure of the control circuit 40 in the device of FIG. 1 is illustrated in FIG. 3. An input terminal 401 is connected to the output terminal of a potentiometer 71 coupled to the motor 16. The terminal 401 is connected through a resistor 405 to the inverting input terminal of an operational amplifier 404. Another input terminal 402 is connected to the output terminal of the temperature detector element 27. The terminal 402 is connected to the non-inverting input terminal of an operational amplifier 404 through a resistor 406 and to the reversion input terminal of an operational amplifier 409. A resistor 407 is connected between the inverting input terminal and the output terminal of the operational amplifier 404. A resistor 408 is connected between the non-inverting input terminal of the operational amplifier 404 and the ground. The operational amplifier 404 and the resistors 405, 406, 407, and 408 constitute a differential amplifier circuit.

The terminal 401 is connected through a resistor 411 to the non-inverting input terminal of the operational amplifier 409. A resistor 412 is connected between the inverting input terminal and the output terminal of the operational amplifier 409. A resistor 413 is connected between the non-inverting input terminal of the operational amplifier 409 and the ground. The operational amplifier 409 and the resistors 410, 411, 412, and 413 constitute a differential amplifier circuit.

The output terminal of the operational amplifier 404 is connected through a resistor 416 to the non-inverting input terminal of an operational amplifier 415. A resistor 417 is connected to the output terminal of a variable resistor 419 and the inverting input terminal of the operational amplifier 415. A resistor 418 is connected between the non-inverting input terminal and the output terminal of the operational amplifier 415 as the positive feed-back resistance. The operational amplifier 415 and the resistors 416, 417, and 418 constitute a comparator having hysteresis characteristic. A constant voltage $V_r$ is supplied to the input terminal of the variable resistor 419.

The output terminal of the operational amplifier 409 is connected through a resistor 421 to the non-inverting input terminal of an operational amplifier 420. A resistor 422 is connected between the output terminal of a variable resistor 424 and the inverting input terminal of the operational amplifier 420. A resistor 423 is connected between the non-inverting input terminal and the output terminal of the operational amplifier 420 as the positive feed-back resistance. The operational amplifier 420 and the resistors 421, 422, and 423 constitute a comparator having hysteresis characteristic. A constant voltage $V_r$ is supplied to the input terminal of the variable resistor 424.

Another input terminal 403 is connected to the output terminal of the water temperature detector element 29. The terminal 403 is connected through a resistor 426 to the inverting input terminal of an operational amplifier 425. A resistor 427 is connected between the output terminal of a variable resistor 429 and the non-inverting input terminal of the operational amplifier 425. A resistor 428 is connected between the inverting input terminal and the output terminal of the operational amplifier 425 as the positive feed-back resistance. The operational amplifier 425 and the resistors 426, 427, and 428 constitute a comparator having hysteresis characteristic. The output terminal of the operational amplifier 425 is connected through a diode 414 to the inverting input terminal of the operational amplifier 409.

A DC voltage of 12 V is supplied to each of the emitter of PNP transistor 430 and 437. The base of the transistor 430 is connected through a resistor 432 to the output terminal of an inverter 431. A resistor 433 is connected between the emitter and the base of the transistor 430. The base of the transistor 437 is connected through the resistor 439 to the output terminal of an inverter 438. A resistor 440 is connected between the emitter and the base of the transistor 430. The input terminal of the inverter 431 is connected to the output terminal of the operational amplifier 415. The input terminal of the inverter 438 is connected to the output terminal of the operational amplifier 420. The collector of the transistor 434 is connected to the collector of the transistor 430. The base of the transistor 434 is connected through a resistor 435 to the output terminal of the operational amplifier 420. A resistor 436 is connected between the base of the transistor 434 and the ground. The emitter of the transistor 434 is grounded. The collector of the transistor 441 is connected to the collector of the transistor 437. The base of the transistor 441 is connected through a resistor 442 to the output terminal of the operational amplifier 415. A resistor 443 is connected between base of the transistor 441 and the ground. The emitter of the transistor 441 is grounded. The collector of the transistor 434 is connected to an output terminal 444 of the control circuit 40, while the collector of the transistor 441 is connected to another output terminal 445 of the control circuit 40. The motor 16 for driving the choke valve 4 is connected between the output terminals 444 and 445. The potentiometer 71 is mechanically coupled via a reduction gear to the shaft of the motor 16. Constant voltages $V_{r1}$, $V_{r2}$, and $V_{r3}$ are supplied to the input terminals of the potentiometer 19, the temperature detector element 27, and the water temperature detector element 29, respectively.

The operation of the control circuit 40 will be described below. The operational amplifier 404, which constitutes an element of a differential amplifier, amplifies the difference between the voltage $V_1$ of the potentiometer 19 and the voltage $V_2$ of the temperature detector member element 27 to produce a voltage $\Delta V_1$. The $\Delta V_1$ is negative when $V_1 > V_2$, while $\Delta V_1$ is positive when $V_1 \leqq V_2$.

The output voltage $\Delta V_2$ of the operational amplifier 409, which constitutes an element of a differential amplifier, will be equal to $-\Delta V_1$, if the resistances of the resistors coupled to the operational amplifier 409 are the same as those of the operational amplifier 404. That is, $\Delta V_2$ is positive when $V_1 \geqq V_2$, while $\Delta V_2$ is negative when $V_1 < V_2$. The comparator comprising the operational amplifier 415 compares the output signal $\Delta V_1$ of the operational amplifier 404 with a predetermined voltage $\Delta V_{r1}$ to produce a high potential output signal when $\Delta V_1 \geqq \Delta V_{r1}$ or a low potential output signal when $\Delta V_1 < \Delta V_{r1}$.

The comparator comprising the operational amplifier 420 compares the output signal $\Delta V_2$ of the operational amplifier 409 with a predetermined voltage $\Delta V_{r1}$ to produce a high potential output signal when $\Delta V_2 \geqq \Delta V_{r1}$ or a low potential output signal when $\Delta V_2 < \Delta V_{r1}$.

Thus, the potential of the output signal of the operational amplifier 415 is high when $V_2 - V_1 \geqq \Delta V_{r1}$ or low when $V_2 - V_1 < \Delta V_{r1}$. The potential of the output signal of the operational amplifier 420 is high when $V_1 - V_2 \geqq \Delta V_{r1}$ or low when $V_1 - V_2 < \Delta V_{r1}$. Accordingly, when $|V_1 - V_2| < \Delta V_{r1}$, the potential of the output signal of the operational amplifier 415 and the potential of the output signal of the operational amplifier 420 are both low, each potential not being high.

When the potential of the output signal of the operational amplifier 415 is high, the transistor 441 becomes conductive and the potential of the output signal of the inverter 431 becomes low, hence the transistor 430 becomes conductive. Thus, a current passes from the output terminal 444 through the motor 16 to the output terminal 445, and, accordingly, the motor 16 is driven to increase the degree of opening of choke valve.

As a result of such drive of the motor 16, the output voltage $V_1$ of the potentiometer 19 is increased. As a result of such an increase of $V_1$, when the condition $V_2 - V_1 < \Delta V_{r1}$ is attained, the transistors 441 and 430 are turned off, hence the rotation of the motor is stopped.

When the state of the operation of the engine is changed to attain $V_1 - V_2 \geqq \Delta V_{r1}$, the potential of the output signal of the operational amplifier 420 becomes high.

When the potential of the output signal of the operational amplifier 420 is high, the transistors 437 and 434 become conductive, hence a current passes from the output terminal 445 through the motor 16 to the output terminal 444, hence the motor 16 is driven to reduce the degree of opening of the choke valve until the condition $V_1 - V_2 < \Delta V_{r1}$ is attained, whereby the rotation of the motor 16 is stopped and the degree of opening of the choke valve is maintained at that at the moment of stoppage of the motor. The value $\Delta V_{r1}$ represents the voltage range defining the dead zone for preventing the oscillation of the motor rotation between the forward and the backward directions.

The potential of the output signal of the comparator comprising the operational amplifier 425 is high when the output voltage $V_3$ of the water temperature detector element 29 is greater than a predetermined voltage, or low when $V_3$ is smaller than the predetermined voltage. The high potential of the output signal of the comparator comprising the operational amplifier 425 supplied to the input terminal 402 through the diode 414 causes the voltage $V_2$ to become extremely great. Accordingly, the degree of opening of the choke valve is increased to attain the full-open position. When the potential of the output signal of the comparator comprising the operational amplifier 425 is low, no influence is exerted on the voltage $V_2$.

Although the above description, describes that the increase of the degree of opening of the choke valve to the full-open position achieved by the change of the voltage $V_2$ due to the output signal of the operational amplifier 425, it is also possible to apply the output signals of the operational amplifiers 425, 415, and 420 to a logic circuit to obtain a resultant signal which causes the degree of opening of the choke valve to be increased to the full-open position unconditionally when the potential of the output signal of the operational amplifier 425 is high.

Further, although the above description describes that the spiral spring 8 is used in the driving mechanism of the choke valve 4, it is also possible to use a coil spring which acts in association with the choke valve. Also, as an alternative method to increase the degree of opening of the choke valve to the full-open position when the temperature of the coolant water is higher than a predetermined temperature, it is possible to adopt a method in which a combination of a valve and a diaphram is used to open or close the path of negative pressure in accordance with the temperature of the coolant water.

Figure 4:
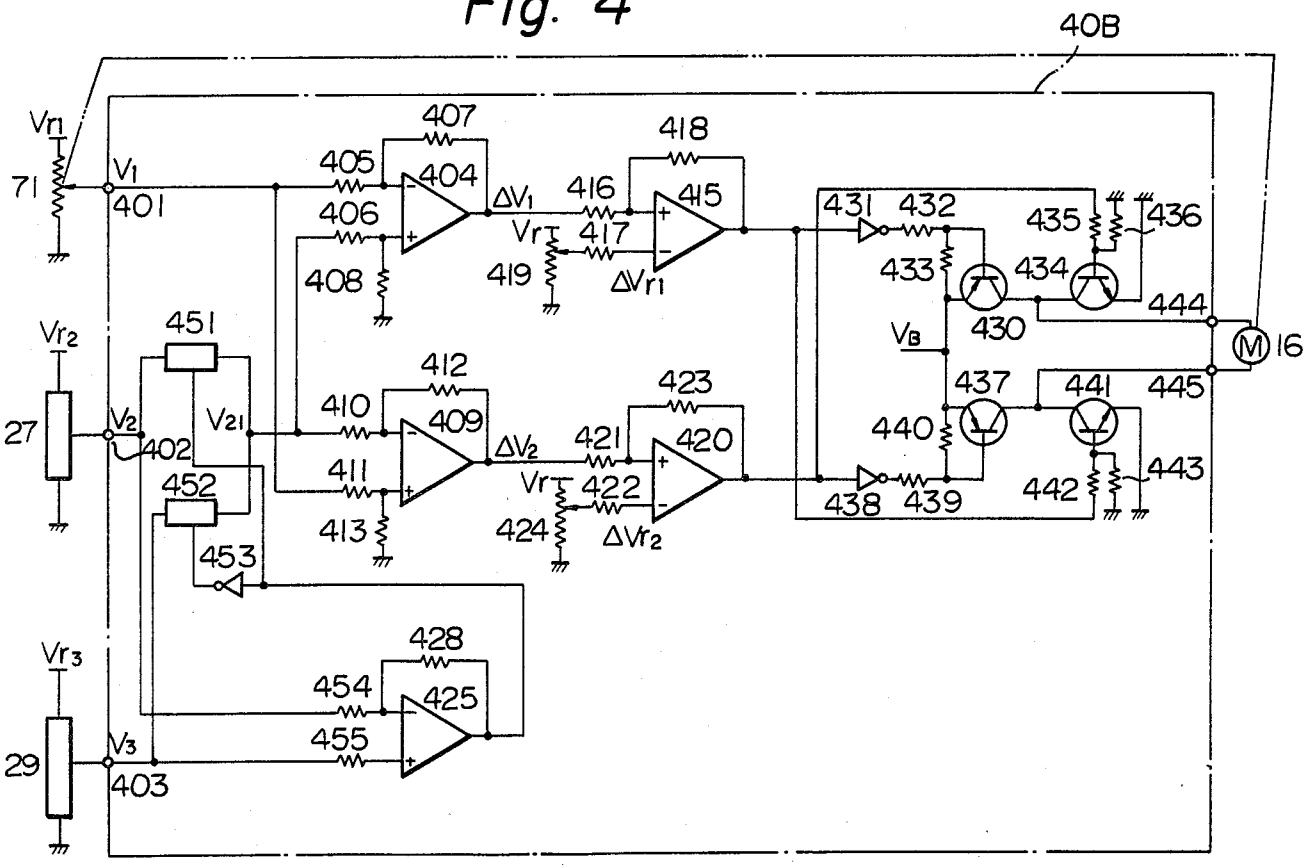
FIG. 4 illustrates a circuit diagram of another example of the control circuit included in the device of FIG. 1.

Another embodiment of the present invention uses the device of FIG. 1 with the control circuit 40B of FIG. 4. In this embodiment, the control circuit is adapted to produce a signal which is responsive to either the temperature of the heating surface of the intake air heating device or the temperature of the coolant in the coolant path, whichever is higher.

The control circuit 40B of FIG. 4 is similar to the control circuit 40 of FIG. 3. The difference between the two resides in the fact that the input terminal 402 is connected through a resistor 454 to the inverting input terminal of the operational amplifier 425, the input terminal 403 is connected through a resistor 455 to the non-inverting input terminal of the operational amplifier 425, the input terminal 402 is connected through an analog switch 451 and a resistor 410 to the inverting input terminal of the operational amplifier 409, and the input terminal 403 is connected through an analog switch 452 and the resistor 410 to the inverting input terminal of the operational amplifier 409.

The operation of the control circuit 40B of FIG. 4 can be understood from the above-described operation of the control circuit 40 of FIG. 3. In the control circuit 40B of FIG. 4, however, the control of the choke valve is carried out on the basis of either the temperature of the heating surface of the intake air heating device or the temperature of the coolant in the coolant path, whichever is higher.

Although the above description describes a proportional function relationship between the degree of opening the choke valve and the temperature detected by the temperature detection element 27 or the water temperature detector element 29, it is possible to change this to another desired function relationship by giving the function characteristics necessary for the realization of the desired function relationship to the signals obtained from the temperature detection element 27, the water temperature detector element 29, and the potentiometer 71.

Figure 5:
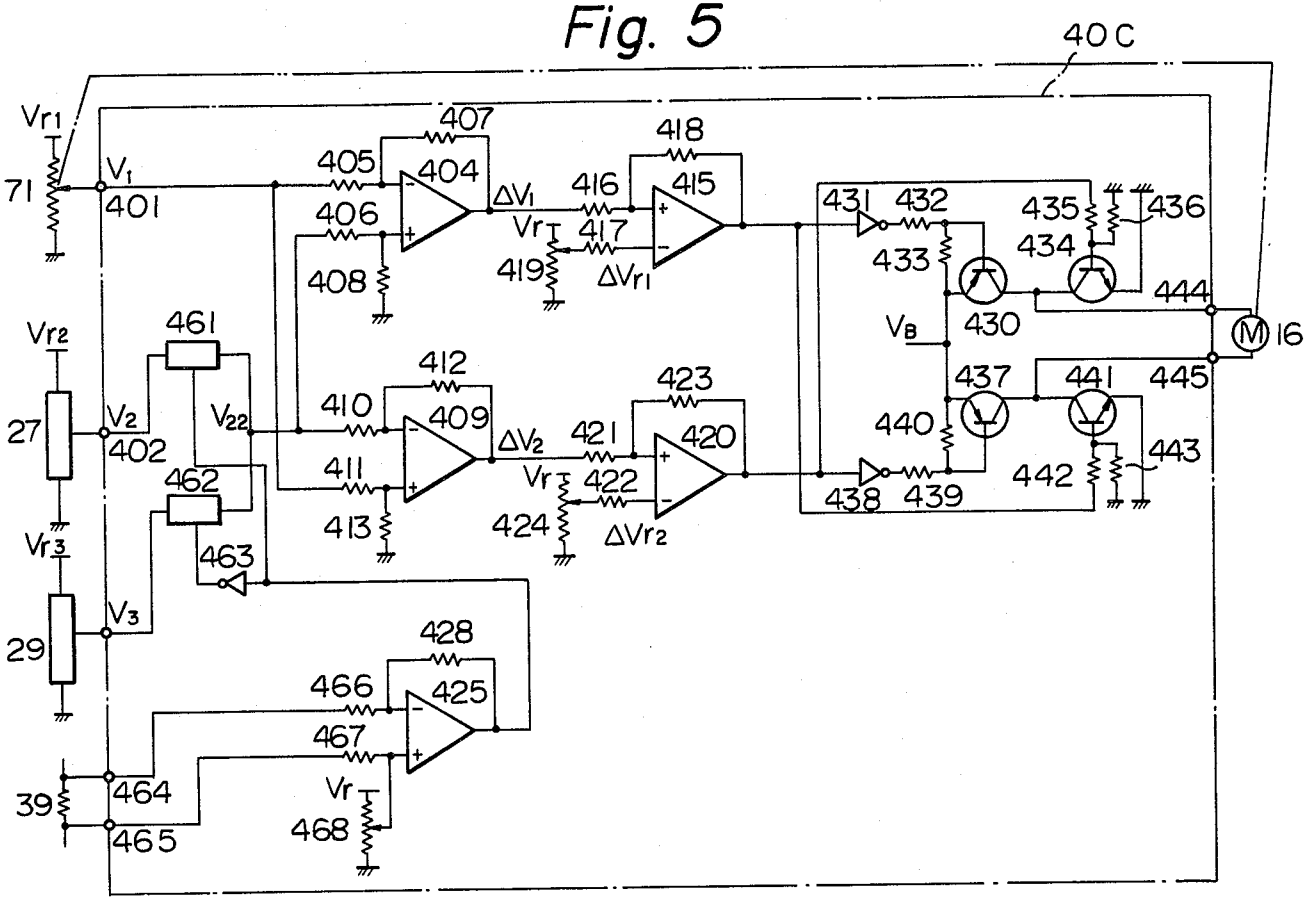
FIG. 5 illustrates a circuit diagram of another example of the control circuit included in the device of FIG. 1.

Another embodiment of the present invention uses the device of FIG. 1 with the control circuit 40C of FIG. 5. This embodiment provides a means for detecting whether a current flows through the intake air heating device and for supplying the resulting detection signal to the control circuit, so that, in accordance with the resulting detection signal, the control circuit produces selectively a signal for controlling the degree of opening of said choke valve corresponding to the temperature of the heating surface of the intake air heating device or a signal for controlling the degree of opening of the choke valve corresponding to the temperature of the coolant in the coolant path.

The control circuit 40C of FIG. 5 is also similar to the control circuit 40 of FIG. 3. One of the differences between the two resides in the fact that a current detection resistor 39 is inserted between the conductor 36 and the positive terminal of the battery power source 37. The voltage across the resistor 39 is supplied to the input terminals 464 and 465 of the control circuit.

Other differences reside in the fact that the input terminal 402 is connected to the input terminal of an analog switch 461, the input terminal 403 is connected to the input terminal of an analog switch 462, the output terminals of the analog switches 461 and 462 are connected to the junction of the resistors 406 and 410, the output terminal of the operational amplifier 425 is connected to the control input terminal of the analog resistor 461 and via an inverter 463 to the control input terminal of the analog resistor 462, the input terminal 464 is connected via a resistor 466 to the inverting input terminal of the operational amplifier 425, and the input terminal 465 is connected via a resistor 467 to the non-inverting input terminal of the operational amplifier 425.

In the operation of the control circuit 40C of FIG. 5, the decision as to whether current passes through the PTC ceramic heater 30 is carried out by using the current detection resistor 39. When current passes through the PTC ceramic heater 30, voltage is produced across the resistor 39, hence the comparator comprising the operational amplifier 425 is operated to produce a high potential output signal. The variable resistor 468 is so arranged that when the voltage across the input terminals 464 and 465 is equal to zero because of the absence of current through the PTC ceramic heater 30, the operational amplifier 425 is operated to produce a low potential output signal.

Thus, by using the control circuit 40C of FIG. 5, control of the degree of opening of the choke valve is carried out in accordance with the temperature of the heating surface of the heater plate 26 when current passes through the PTC ceramic heater 30 and is carried out in accordance with the temperature of the coolant water 25 in the coolant path when no current passes through the PTC ceramic heater 30.

Figure 6:
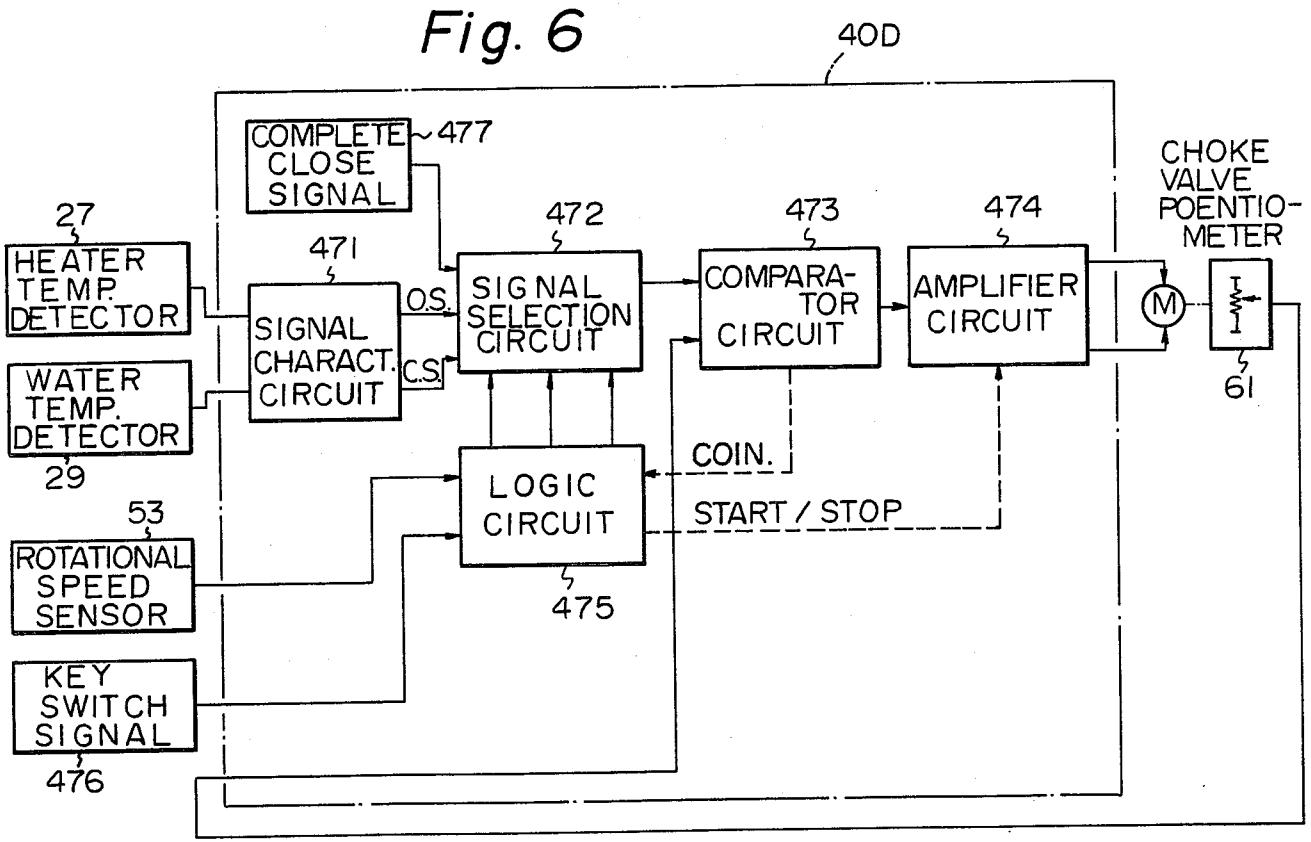
FIG. 6 illustrates a block diagram of further example of the control circuit included in the device of FIG. 1.

Another embodiment of the present invention uses the device of FIG. 1, with the control circuit 40D of FIG. 6. In this embodiment, the choke valve pulling angle under the perfect combustion condition of the engine is selected in accordance with the signal obtained as the result of the temperature detection.

The control circuit 40D of FIG. 6 receives the signal representing the temperature of the heater supplied from the temperature detector element 27, the signal representing the temperature of the coolant water supplied from the coolant water temperature detector element 29, the signal representing the rotational speed of the engine and capable of indicating the perfect combustion state of the engine supplied from the rotational speed sensor 53, and the output signal of a choke valve potentiometer 61 for detecting the degree of opening of the choke valve.

The rotational speed sensor 53 is positioned opposite to the rotating member 52 attached to the crankshaft of the engine 51, in order to produce pulse signals corresponding to the rotational speed of the engine 51. The choke valve potentiometer 61 for detecting the degree of opening of the choke valve is coupled to the shaft 5 of the choke valve 4.

The control circuit 40D of, FIG. 6 comprises a complete-close signal circuit 477, a signal characteristic circuit 471, a signal selection circuit 472, a comparator circuit 473, an amplifier circuit 474, a logic circuit 475, and a key-switch signal circuit 476.

Two kinds of signal characteristics are provided in the signal characteristic circuit 471, corresponding to the opening side characteristic (O.S.) and the closing side characteristic (C.S.) of the choke valve with respect to temperatures related to the engine, such as the temperature of the intake air or the temperature of the coolant water.

Figure 7:
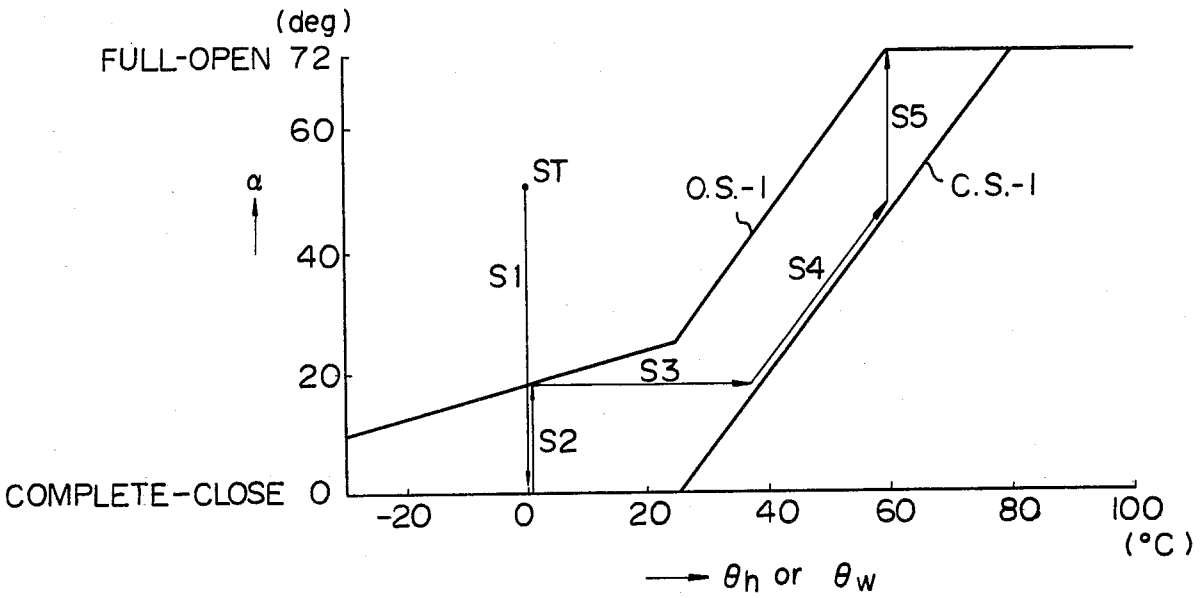
FIGS. 7, 8, 9, and 10 illustrate examples of the operation characteristics of the device of FIG. 6.

The operation of the control circuit 40D of FIG. 6 will now be described. An example of the relationship between the temperature ($\theta_h$, $\theta_w$) of the heating surface of the heater plate 26 and the coolant water 25 and the degree ($\alpha$) of opening of the choke valve is illustrated in FIG. 7. In FIG. 7, the line O.S.-1 represents the opening side characteristic, while the line C.S.-1 represents the closing side characteristic. It can be seen in FIG. 7 that the opening of the choke valve takes place at a lower temperature in the opening side (O.S.-1) than in the closing side (C.S.-1). The steps of operation of the choke valve are illustrated by the lines S1, S2, S3, S4 and S5.

It is assumed that, at the beginning, the choke valve is in the state at point ST, the opening degree at which point is 50 degrees and the temperature of the heating surface at which point is 0° C. The key-switch is turned on, and the logic circuit 475 produces a selection signal which is supplied to the selection circuit 472. In this case, the selection circuit 472 selects. The complete-close signal from the signals from the complete-close signal circuit 477 and the signal characteristic circuit 471.

Then, the command output signal of the selection circuit 472 is supplied to the comparator circuit 473, the output signal of which is supplied to the amplifier circuit 474. The output signal of the amplifier circuit 474 is supplied to the motor 16 to drive the choke valve. The degree of opening of the choke valve is detected by the choke valve potentiometer 61 coupled to the shaft 5 of the choke valve 4. The output signal of the choke valve potentiometer 61 is supplied to one of the input terminals of the comparator circuit 473. The comparator circuit 473 supplies a signal to the amplifier circuit 474 so that the command signal supplied from the selection circuit 472 coincides with the signal supplied from the choke valve potentiometer 61. When the command opening degree signal and the output signal of the choke valve potentiometer 61 become equal, a coincidence signal (COIN) is supplied from the comparator circuit 473 to the logic circuit 475, hence the start signal is supplied from the logic circuit 475 to the amplifier circuit 474.

As the result, the degree of opening of the choke valve immediately after turn-on of the key-switch becomes the complete-close state as indicated by S1 in FIG. 7.

The operation after the start of the engine will now be described. After the start, the status where the engine exceeds a predetermined speed, for example, 200 rpm, is regarded as perfect combustion. The signal obtained under this status is used as the perfect combustion signal.

When the perfect combustion signal is supplied to the logic circuit 475, the selection circuit 472 selects the signal of the opening side characteristic from the signal characteristic circuit 471. The motor 16 is driven on the basis of the output signal of the selection circuit 472 so that the choke valve attains the value of the degree of opening on the line O.S.-1, as indicated at S2 in FIG. 7.

When the degree of opening of the choke valve becomes equal to the command opening degree of the choke valve, a stop signal based on the coincidence signal from the comparator circuit 473 is supplied to the amplifier circuit 474 to stop the motor 16, so that, as the temperature $\theta_h$ or $\theta_w$ increases, the choke valve is maintained at the value of the degree of opening on the line O.S.-1, as indicated at S3 in FIG. 7.

At the end of step S3, where the above-maintained value of the degree of opening is equal to the value on the line C.S.-1, the selection circuit 472 selects the signal of the closing side characteristic from the signal characteristic circuit 471. The motor 16 is driven on the basis of the output signal of the selection circuit 472 so that the degree of opening of the choke valve changes along the line C.S.-1, as indicated at S4 in FIG. 7.

When the coolant water reaches a predetermined temperature, such as 60° C., the command signal for the full-open position is supplied to the comparator circuit 473 to immediately increase the degree of opening from the value on line C.S.-1 to the full-open status, as indicated at S5 in FIG. 7.

Figure 8:
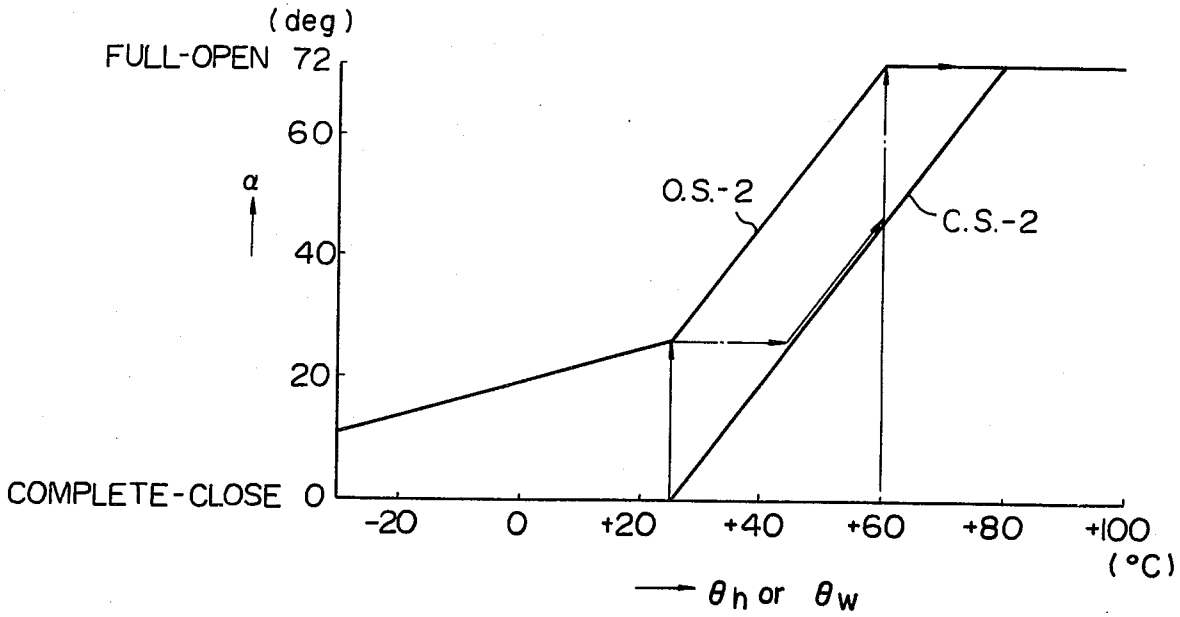
Figure 9:
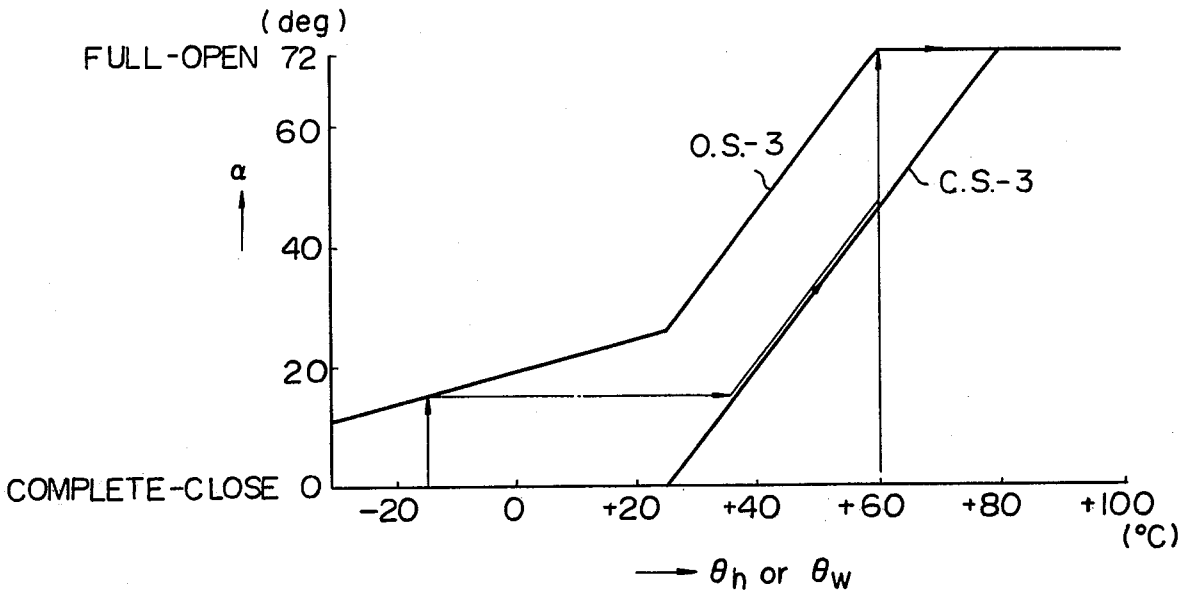

Other examples of the operation characteristic of the control circuit of FIG. 6 are illustrated in FIGS. 8 and 9. O.S.-2 and O.S.-3 represent the opening side characteristics, while O.S.-3 and C.S.-3 represent the closing side characteristics. In the operation illustrated in FIG. 8, the device is started from the state where the temperature is 25° C. In the operation illustrated in FIG. 9, the device is started from the state where the temperature is −15° C.

Figure 10:
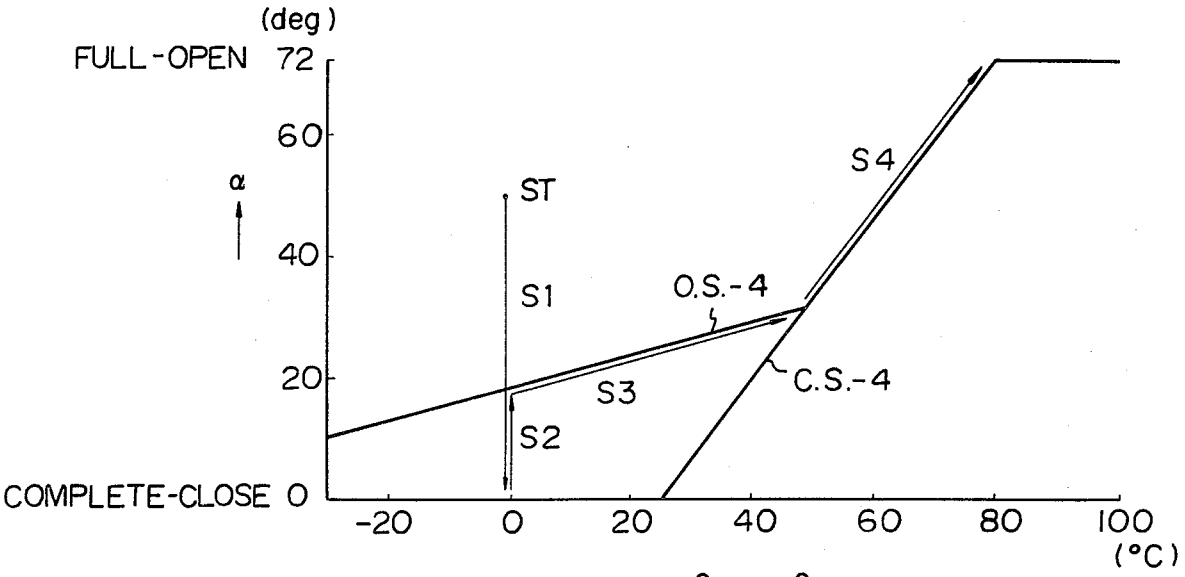

A further example of the operation characteristic of the control circuit of FIG. 6 is illustrated in FIG. 10. O.S.-4 represents the opening side characteristic, while C.S.-4 represents the closing side characteristic. Unlike the operation characteristics illustrated in FIGS. 7, 8 and 9, O.S.-4 has a single gradient and intersects C.S.-4. The operation characteristic of FIG. 10 is similar to those of FIGS. 7, 8, and 9. However, in the operation characteristic of FIG. 10, after the state of perfect combustion in step S2, the degree of opening of the choke valve changes in accordance with step S3 along O.S.-4 and step S4 along C.S.-3.

Although the preferred embodiments have been described hereinbefore, it should be understood that various changes and modifications are possible for persons skilled in the art within the scope of the appended claims.

We claim:

1. A device for controlling a choke valve in a carburetor for an internal combustion engine having an intake manifold, comprising:

intake air heating means, having a heating surface and a bottom surface opposite said heating surface, for heating intake air;

temperature detecting means for detecting the temperature of said heating surface of said heating means;

control circuit means, responsive to a signal from said temperature detecting means, for generating an output signal related to the detected temperature of said heating surface; and driving means, responsive to said output signal of said control circuit means, for changing the degree of opening of said choke valve.

2. A device as defined in claim 1, wherein:

said heating means includes a ceramic heater having a positive temperature coefficient attached to said bottom surface of said heating means; and said temperature detecting means is attached to a portion of said heating means other than said ceramic heater on said bottom surface of said heating means.

3. A device as claimed in claim 1, further comprising additional temperature detecting means for detecting the temperature of coolant in a coolant path adjacent to an air path of said intake manifold said control circuit means being responsive to said additional detecting means.

4. A device as defined in claim 3, wherein said control circuit means produces a signal to fully open said choke valve when the coolant temperature is higher than a preselected temperature.

5. A device as defined in claim 3, wherein said control circuit means produces a signal which is responsive to one of the temperature of said heating surface of said heating means and the temperature of the coolant in said coolant path, whichever is higher.

6. A device as defined in claim 3, wherein:

said device further comprises means for detecting whether a current flows through said heating means; and in accordance with a signal from said current detecting means, said control circuit means produces selectively one of a signal for controlling the degree of opening of said choke valve corresponding to the temperature of said heating surface of said heating means and a signal for controlling the degree of opening of said choke valve corresponding to the temperature of the coolant in said coolant path.

7. A device as defined in claim 1, wherein a plurality of opening degree characteristics of the choke valve corresponding to various temperatures are provided in said control circuit, said control circuit adjusting the degree of opening of said choke valve in accordance with different opening degree characteristics corresponding to different temperatures.

8. A method for controlling a choke valve in a carburetor for an internal combustion engine having an intake manifold comprising the steps of:

monitoring the temperature of a heating surface of heating means for heating intake air; and controlling the degree of opening of said choke valve in response to said monitoring step.

9. A method as defined in claim 8 wherein:

said method further comprises the step of monitoring the temperature of coolant in a coolant path adjacent to an air path of said intake manifold; and said controlling step controls the degree of opening of said choke valve in response to said coolant temperature monitoring step.

10. A method as defined in claim 9 wherein said controlling step controls said choke valve in response to the higher of the temperature of said heating surface and the temperature of said coolant.

11. A method as defined in claim 9 wherein:

said method further comprises the step of detecting whether current is flowing through said heating means; and said controlling step controls the degree of opening of said choke valve in response to one of the temperature of said heating surface and the temperature of said coolant depending on the result of said detecting step.

* * * * *